US006251200B1

(12) United States Patent
Dunne

(10) Patent No.: US 6,251,200 B1
(45) Date of Patent: Jun. 26, 2001

(54) PROCESS AND APPARATUS FOR INFLATING AIRBAGS AND REMEDIATING TOXIC WASTE GASES

(75) Inventor: Stephen R. Dunne, Algonquin, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 09/342,758

(22) Filed: Jun. 29, 1999

(51) Int. Cl.[7] ..... D03D 23/00; B60R 21/28

(52) U.S. Cl. ..... 149/108.4; 149/109.6; 280/741

(58) Field of Search ..... 280/741; 502/60; 423/700, 718; 149/19.92, 109.6, 108.4

(56) References Cited

U.S. PATENT DOCUMENTS

| | | | | |
|---|---|---|---|---|
| 2,882,243 | * | 4/1959 | Milton | 252/455 |
| 2,882,244 | * | 4/1959 | Milton | 252/455 |
| 3,316,691 | * | 5/1967 | Sesny et al. | 55/60 |
| 3,411,808 | | 11/1968 | Chute | 280/150 |
| 3,413,013 | | 11/1968 | Wissing et al. | 280/150 |
| 3,715,983 | * | 2/1973 | Rosinski | 241/1 |
| 3,880,447 | | 4/1975 | Thorn et al. | 280/150 AB |
| 4,068,862 | | 1/1978 | Ishi et al. | 280/740 |
| 4,547,342 | | 10/1985 | Adams et al. | 422/166 |
| 4,561,675 | | 12/1985 | Adams et al. | 280/734 |
| 4,711,466 | | 12/1987 | Breed | 280/741 |
| 4,722,551 | | 2/1988 | Adams | 280/736 |
| 5,275,433 | * | 1/1994 | Klober et al. | 280/741 |
| 5,841,065 | * | 11/1998 | Mendenhall | 149/37 |
| 5,975,570 | * | 11/1999 | Bosio | 280/741 |
| 6,059,906 | * | 5/2000 | Fleming et al. | 149/19.92 |

FOREIGN PATENT DOCUMENTS

| | | | | |
|---|---|---|---|---|
| 197 56 779 A1 | | 7/1998 | (DE) . | |
| 0049936 | * | 4/1982 | (EP) | B01J/19/04 |
| 0842828 A1 | | 5/1998 | (EP) . | |

* cited by examiner

*Primary Examiner*—Michael J. Carone
*Assistant Examiner*—Aileen J. Baker
(74) *Attorney, Agent, or Firm*—John G. Tolomei; Richard P. Silverman

(57) ABSTRACT

Molecular sieve zeolites are incorporated in the inflator device to assist in the inflation of airbags in passenger vehicles. The pre-loading of the molecular sieve zeolites with gases such as air or nitrogen or carbon dioxide provides for rapid airbag inflation and following inflation, additionally provides the remediation of at least a portion of the toxic waste gases generated by the exploding inflator device. Molecular sieve zeolites, particularly zeolites X, having been exchanged with lithium or calcium, provide high-capacity gas storage and enhanced toxic waste gas adsorption. The use of molecular sieve zeolites reduces risk of injury to occupants of vehicles from exposure to hot, toxic waste gases following airbag deployment.

9 Claims, 1 Drawing Sheet

PROCESS AND APPARATUS FOR INFLATING AIRBAGS AND REMEDIATING TOXIC WASTE GASES

FIELD OF INVENTION

This invention relates to automobile passive restraint safety devices and, more particularly, to pyrotechnic gas generator units for inflating automobile airbags.

BACKGROUND OF THE INVENTION

Large numbers of people are killed or injured annually in automobile accidents wherein the driver and/or passengers are thrown forward so as to impact against solid surfaces within the vehicle. Consequently, there has been considerable development of passive restraint systems for use with these vehicles. The term "passive" means that the driver or passenger need not do anything to benefit from the device, as opposed to seat belts which are considered to be an "active" restraint system. One system which has been extensively investigated senses rapid deceleration of the vehicle such as that which occurs upon a primary impact between an automobile and, for example, another car. It thus initiates inflation of a bag between the interior surface of the car and the vehicle occupant prior to the occurrence of any secondary collision between the driver and/or passengers and the interior of the car. Airbags have been in widespread use for more than a decade, but accounts of injuries and fatalities caused by their explosive deployment have raised concerns about their safety. Airbag inflation speeds of nearly 200 miles per hour or more are common to compensate for the driver's or the passenger's forward motion during a frontal impact. Inflation of the bag must therefore occur within milliseconds of the primary impact in order to restrain any occupants before they are injured due to secondary collisions against the solid surfaces within the vehicle.

As noted above, there are in the prior art various devices which cause a protective bag to inflate in front of an automobile driver or passenger to cushion the impact with the steering wheel, dashboard or other interior vehicle surface. Usually the device is activated by an inertial switch responsive to a primary crash impact. This inertial switch in turn causes an inflator apparatus to quickly inflate a collapsed bag into a protective position in front of the driver or passenger.

The inflating gas is generally supplied either from a source of compressed air or other compressed gas, such as shown in Chute, U.S. Pat. No. 3,411,808 and Wissing et al., U.S. Pat. No. 3,413,013, and a number of other patents in the crash restraint field. In several other prior art patents (e.g., U.S. Pat. No. 3,880,447 to Thorn et al.; U.S. Pat. No. 4,068,862 to Ishi et al.; U.S. Pat. No. 4,711,466 to Breed; and U.S. Pat. Nos. 4,547,342; 4,561,675 and 4,722,551 to Adams et al.), the bag is inflated by igniting a pyrotechnic propellant composition and directing the gaseous combustion products produced thereby directly into the bag.

The first technique discussed above for inflating an airbag requires a reservoir of gas stored at a very high pressure, which may be discharged into the bag as soon as an impact is sensed. In order to obtain a sufficient volume of gas for inflating a vehicle occupant restraint bag, however, a relatively large reservoir of gas, at pressures of 3000 psi or more is required. To open the gas reservoir in the very short time interval required for ensuring the safety of the vehicle occupants, explosive arrangements have been employed in the prior art for bursting a diaphragm or cutting through a structural portion of the reservoir. Such explosive arrangements have significant inherent safety problems, such as the production of shrapnel by the explosion, as well as the relatively high sound level reached within the passenger compartment due to the explosion. The psychological factor of having these explosives in each automobile also cannot be ignored.

The second technique discussed above employs a pyrotechnic gas generator, or explosive gas generator, having a rapidly burning propellant composition stored therein for producing substantial volumes of hot gaseous products which are then directed into the inflatable bag. Some compositions are available which produce a sufficiently low temperature combustion gas such that the gas may be substantially directed into the bag without danger to the vehicle's occupants. Other systems produce a high temperature combustion product requiring means for cooling the gas before it is introduced into the bag.

Many forms of gas generators or inflators utilizing combustible solid fuel gas generating compositions for the inflation of crash protection, i.e., "airbag", restraint systems are known in the prior art. Commonly encountered features among generators utilized for this purpose include: (1) an outer metal housing, (2) a gas generant composition located within the housing, (3) means to ignite the gas generant responsive to a signal received from a sensor positioned at a location removed from the inflator, and (4) means to filter and to cool the gas, positioned between the propellant composition and a plurality of gas discharge orifices defmed by the generator housing.

One such gas generator includes an annular combustion chamber which is bounded by a welded outer casing or housing structure. The combustion chamber encloses a rupturable container or cartridge that is hermetically sealed and which contains a solid gas generant in pelletized form, surrounded by an annular filter assembly. The device further includes a central ignition or initiator zone and a toroidal filter chamber adjoining and encircling the combustion chamber. An inner casing or housing structure is located in close surrounding and supporting relationship to the rupturable container, the inner casing being formed by a cylinder having uniformly spaced peripheral ports or orifices near one end. These orifices provide exit holes to facilitate the flow of gas from the combustion chamber.

EP-0842828A1 discloses an apparatus for enhancing the operation of an airbag generator based on the use of an explosive device combined with an oxide or zeolite molecular sieve which is coated or applied to the interior surface of a chamber containing stored gas to assist in supplying gas to the airbag in the final phase of the airbag deployment.

Pyrotechnic devices generate gases at high temperatures and produce potentially toxic materials. It is an objective of the present invention to reduce the amount of toxic gases generated during the deployment of an airbag to protect the occupant or driver of the vehicle.

It is an objective to reduce the potential hazard to a driver or passenger of a vehicle employing passive restraints by reducing the temperature of the gases generated by a pyrotechnic inflator.

It is an objective of the present invention to provide a safe method of storing gas and to provide a process for scavenging of toxic gases generated in the deployment of an airbag system.

SUMMARY OF THE INVENTION

The present invention provides two novel improvements to airbag inflators of the prior art to significantly reduce the potential hazard to the driver or passenger of the vehicle. By the pre-loading of the molecular sieve zeolites with gases such as air, nitrogen, or carbon dioxide, the invention provides for rapid airbag inflation by the rapid desorption of this pre-loaded gas. This additional amount of gas evolved reduces the amount of explosive required to inflate the bag which reduces the amount of toxic gases generated by the explosion itself, and the expansion of the stored gas provides a substantial amount of cooling. Following the evolution of the stored gas and combined with the heat provided by the explosion, the adsorbent is now in an activated form and moving freely, or fluidized, within the airbag. It is at this point, the adsorbent additionally provides the remediation of toxic waste gases generated by the exploding inflator device. Molecular sieve zeolites, particularly zeolite X, having been exchanged with lithium or calcium provide both high-capacity gas storage and enhanced toxic waste gas adsorption. The use of molecular sieve zeolites reduces risk of injury to occupants of vehicles from exposure to hot, toxic waste gases following airbag deployment.

In one embodiment, the present invention is an explosive airbag inflator comprising a pyrotechnic to produce a generated gas and a zeolite molecular sieve which was pre-loaded with a stored gas. The generated gas comprises toxic compounds. The zeolite molecular sieve is disposed in a zeolite layer adjacent to the pyrotechnic. Upon detonation, a sufficient amount of zeolite molecular sieve is present to reduce the temperature of the generated gas and to scavenge at least a portion of the toxic compounds passed to the airbag.

In another embodiment, the present invention is an explosive airbag inflator comprising a cup having a hollow interior and an open end, a layer of pyrotechnic disposed in the hollow interior, a layer of zeolite molecular sieve pre-loaded with nitrogen or carbon dioxide and disposed on the layer of pyrotechnic, and a membrane or rupture disk disposed over the layer of zeolite molecular sieve.

In a further embodiment, the present invention is a process for reducing the temperature of an inflating airbag. The process comprises the steps of detonating an airbag inflator comprising a pyrotechnic adjacent to a zeolite molecular sieve. The molecular sieve was pre-loaded with a stored gas. The pyrotechnic provides a generated gas which comprises toxic compounds. The stored gas from the zeolite molecular sieve is desorbed and expanded in the detonation to cool the generated gas and to fluidize at least a portion of the zeolite molecular sieve. At least a portion of the toxic compounds is adsorbed on the zeolite molecular sieve.

BRIEF DESCRIPTION OF THE DRAWING

The FIGURE is a side view of the apparatus of the present invention.

DETAILED DESCRIPTION OF THE INVENTION

Figure 1:
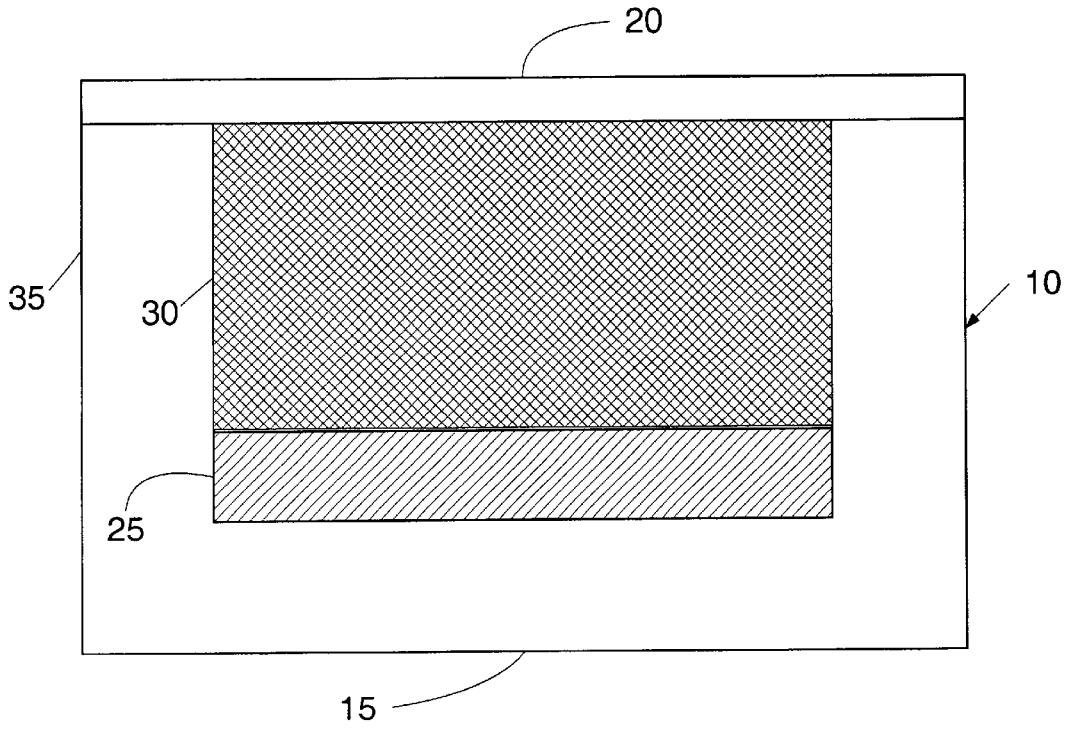

Inside airbags are pyrotechnic materials which produce gas to fill the airbag with the products of a chemical reaction. Most pyrotechnics used in airbags employ chemical reactions which produce nitrogen such as sodium azide or nitrocellulose. In pyrotechnic systems for airbag inflation, when the main chemical component in the airbag inflator is sodium azide, the sodium azide is mixed together with potassium nitrate and silicon dioxide. This mixture is generally ignited by means of an electrical impulse which results in a detonation or deflagration that liberates a predetermined volume of predominantly nitrogen gas which fills the airbag. The detonation proceeds according to the following major chemical reaction:

$$2\ NaN_3 \rightarrow 2Na + 3N_2 \quad (1)$$

The sodium by-product of reaction reacts with potassium nitrate to generate additional amounts of nitrogen according to the following reaction:

$$10Na + 2\ KNO_3 \rightarrow K_2O + 5\ Na_2O + N_2 \quad (2)$$

The combination of equations (1) and (2) provide an opportunity for the following third reaction to take place:

$$K_2O + Na_2O + SiO_2 \rightarrow \text{alkaline silicate} \quad (3)$$

The alkaline silicate, or glass, produced by reaction (3) is a stable compound which does not burn any further. All of these reactions are highly exothermic and occur very rapidly resulting in the production of hot gases. Generally, the components of a pyrotechnic device provide an explosion that releases hot gas at a rate which is sufficient to fill a driver-side airbag (about 35 to 40 liters in volume) within about 35 milliseconds from the time the pyrotechnic device is fired. Other pyrotechnic devices known in the art with different pyrotechnic formulations may evolve more heat and deliver hot gases at even higher temperatures.

The present invention is directed to the cooling of gases generated by airbag inflators which employ pyrotechnics to provide a generated gas to inflate the airbag. When pyrotechnics are detonated, they produce a generated gas at high temperatures. Pyrotechnics such as sodium azide produces primarily nitrogen gas. Nitrocellulose on detonation produces nitrogen and oxides of nitrogen and carbon monoxide. The reactions produced on detonation of the pyrotechnics are highly exothermic and produce gases at temperatures approaching 3000° C. U.S. Pat. No. 3,912,561 to Doin et al. discloses the gas generating pyrotechnic composition which comprises a fuel selected from the group consisting of alkali metal azides and alkaline earth metal azides combined with an alkali metal oxidant, a nitrogenous compound, and optionally an additive such as silica for reacting with the solid combustion residues. The contents of U.S. Pat. No. 3,912,561 are herein incorporated by reference.

Airbags generally range in size from as low as 30 liters for a small driver-side airbag up to about 70 liters for a passenger-side airbag. These airbags must be inflated in a sufficiently short period of time, preferably less than about 50 milliseconds (ms), which prevents injury to the driver or the passenger from striking the inside of the vehicle. Inflation time for a driver-side airbag is typically about 35 ms and inflation time for a passenger-side airbag is about 55 ms. Longer inflation times for the passenger-side are permitted because of the longer pathway between the occupant and the interior surface of the vehicle. If the airbag is inflated too aggressively, the bag itself will become hazardous to the driver and passengers. Therefore, typical airbags must be inflated rapidly and allowed to begin a deflation process all within a very short period time. It is believed that the problem of handling airbag deployment can be viewed by recognizing the definition of pressure. Pressure is the net rate of momentum transfer per unit area. Furthermore, the characteristic of the gas assures us that the distribution of molecular velocities is a function of gas temperature. Thus, higher temperatures have higher velocities and higher distributions of gas velocities. Therefore, a higher average molecular velocity implies a higher average pressure and a more aggressive deployment. For a 40-liter airbag, the total gas release potential is about 1.12 moles of nitrogen from the gas generated by the pyrotechnic which is equivalent to about 70 grams of a typical sodium azide compound of the prior art.

When the pyrotechnic produces or generates the gas to inflate the airbag, the generated gases are produced at the temperature of the reaction which typically ranges between about 2400° and about 2700° C. As these gases are produced, they undergo an expansion into the airbag which provides some cooling. However, the cooling provided by this natural expansion of the generated gases into the airbag still results in very hot gases entering the airbag. If the gas generated by the pyrotechnic is cooled to a still lower temperature, then additional moles of gas are required to inflate the airbag. The present invention provides the cooling of the hot generated gases by absorbing some of the heat by desorbing the stored gases from the zeolite molecular sieve. It is the heat of desorption of the stored gases which provides the cooling. Additional cooling is provided by the further expansion of the stored gases into the airbag while providing additional moles of gas to maintain the safe inflation of the airbag within the very short deployment time required.

The additional stored gas is supplied by pre-loading an inert gas such as nitrogen or carbon dioxide on a zeolite molecular sieve. Nitrogen is preloaded on a zeolite molecular sieve such as zeolite X by activating the zeolite molecular sieve in the conventional manner and exposing the zeolite molecular sieve at an elevated adsorption pressure ranging from about 5 to about 70 atmospheres (atm) to a gas stream comprising nitrogen. More preferably, the elevated adsorption pressure comprises a pressure between about 30 and about 70 atm. The zeolite molecular sieve capacity for nitrogen at about 68 atm is about 12.6 weight percent. Preferably, the zeolite molecular sieve comprises a highly exchanged zeolite X with a cation selected from the group consisting of sodium, lithium, calcium and mixtures thereof. More preferably, the zeolite molecular sieve comprises a highly exchanged zeolite X having been at least 67 percent exchanged with a cation selected from the group consisting of lithium, calcium and mixtures thereof. Most preferably, the zeolite molecular sieve comprises a highly exchanged zeolite X having been at least 80 percent exchanged with a cation selected from the group consisting of lithium, calcium and mixtures thereof. Preferably, the zeolite molecular sieve comprises a particle size between about 1.4 and about 2.0 mm.

The stored gas can comprise nitrogen or carbon dioxide. Carbon dioxide has the added advantage in this application in that carbon dioxide can be stored as adsorbed gas on the sieve, or encapsulated into the zeolite molecular sieve. By the term "encapsulated," it is meant that the zeolite molecular sieve is activated in the conventional manner and exposed to a gas stream comprising carbon dioxide at a high adsorption pressure of about 60 to 80 atm and a high adsorption temperature around 125° C. (400 Kelvin) to about 177° C. (450 Kelvin) to adsorb the carbon dioxide, depending upon the amount of carbon dioxide to be stored. Following the adsorption step, the zeolite molecular sieve is pore closed by quickly cooling the zeolite molecular sieve to about room temperature and slowly reducing the pressure to about 1 to about 5 atm. Carbon dioxide capacities of up to about 20 weight percent of the zeolite molecular sieve can be achieved in this manner. When encapsulation is employed for example with carbon dioxide, preferably the zeolite molecular sieve is selected from the group consisting of potassium exchanged zeolite A, potassium exchanged erionite, sodium exchanged clinoptilolite, and mixtures thereof. Carbon dioxide can be stored or encapsulated and employed in an airbag system at relatively low pressure (about 1 to about 5 atm) compared to the pressure required to store nitrogen or other inert gas.

Once the zeolite molecular sieve has been pre-loaded with the stored gas, the zeolite molecular sieve should be maintained at a storage pressure to maintain the level of the stored gas in the zeolite molecular sieve. This is accomplished by sealingly covering the zeolite molecular sieve with a membrane or a rupture disk which will maintain the desired pressure of the stored gas.

According to the present invention, the zeolite molecular sieve is positioned adjacent to the pyrotechnic such that on detonation, a portion of the heat of the pyrotechnic reaction will be employed to desorb the stored gas from the zeolite molecular sieve. In addition, the force of the pyrotechnic detonation is employed to fluidize at least a portion of the zeolite molecular sieve into the airbag with the generated and stored gases. As the now desorbed zeolite molecular sieve cools, it adsorbs toxic compounds generated in the detonation such as oxides of nitrogen and carbon monoxide. The evolution of the stored gas from the zeolite molecular sieve provides cooling of the gases passed to the airbag and it provides the additional gas required to quickly inflate the airbag to compensate for the cooler gas in the airbag. Preferably, the pre-loaded zeolite molecular sieve is 25 to about 70 weight percent of the pyrotechnic charge mass.

Zeolitic molecular sieves in the calcined form may be represented by the general formula:

$$Me_{2/n}O:Al_2O_3:xSiO_2$$

where Me is a cation, x has a value from about 2 to infinity, and n is the cation valence. Typical well-known zeolites which may be used include: chabazite—also referred to as zeolite D, clinoptilolite, EMC-2, zeolite L, ZSM-5, ZSM-11, ZSM-18, ZSM-57, EU-1, offretite, faujasite, erionite, ferrierite, mordenite, zeolite A, ZK-5, zeolite rho, zeolite Beta, boggsite, and silicalite. The adsorbent of the present invention will be selected from these zeolite adsorbents, cation exchanged forms of these zeolites, and mixtures thereof.

The term "pore opening" refers to the pore diameter of the adsorbent within the crystal structure of the adsorbent. Zeolite molecular sieves have pores of uniform opening, ranging from about 3 to about 10 angstroms, which are uniquely determined by the unit structure of the crystal. These pores will completely exclude molecules which are larger than the opening of the pore. The preferred adsorbents for use with the present invention include synthetic and naturally occurring zeolites with a silica-to-alumina ratio greater than about 2 to about 3 and having a pore opening larger than 4.3 angstroms. More particularly, synthetic and naturally occurring zeolites having a FAU structure as defmed in the "Atlas of Zeolite Structure Types," by W. M. Meier and D. H. Olson, issued by the Structure Commission of the International Zeolite association, (1987), on pages 53–54 and pages 91–92, are preferred. The above reference is hereby incorporated by reference. Most preferably, the zeolite adsorbent for use with the present invention will have a silica-to-alumina ratio greater than or equal to about 2 and a pore opening greater than about 8 angstroms.

It is often desirable when using crystalline molecular sieves that the molecular sieve be agglomerated with a binder in order to ensure that the adsorbent will have suitable particle size. Although there are a variety of synthetic and naturally occurring binder materials available such as metal oxides, clays, silicas, aluminas, silica-aluminas, silica-zirconias, silica-thorias, silica-berylias, silica-titanias, silica-alumina-thorias, silica-alumina-zirconias, mixtures of these and the like, silica binders are preferred. Clay is preferred because it may be employed to agglomerate the molecular sieve without substantially altering the adsorptive properties of the zeolite. The choice of a suitable binder and methods employed to agglomerate the molecular sieves are generally known to those skilled in the art and need not be further described herein.

The results of both laboratory evaluations using stored gas on zeolite molecular sieve in rapid depressurization tests and engineering simulation of stored gas and pyrotechnic gas inflators show an advantage for combining the functions of gas storage by zeolite adsorbents with the gas and heat releases of pyrotechnic compounds to significantly reduce the temperature of the gas delivered to the airbag. The zeolite hybrid generator can inflate the airbag with nitrogen gas within time periods that are very comparable with existing pyrotechnic devices while delivering the gas at temperatures that are much cooler than the gas delivered by the solely pyrotechnic devices.

DETAILED DESCRIPTION OF THE DRAWING

Referring to the FIGURE, a side view of the apparatus of the present invention is shown. According to the FIGURE, the airbag inflator comprises a shell 10 having a bottom 15 and a surround 35 which forms the sides of the shell. The bottom is sealingly attached to the sides of the shell forming an interior shell zone. A layer of a pyrotechnic 25 comprising sodium azide or nitrocellulose is disposed on the bottom of the shell in a layer of explosive. A layer of zeolite particles 30 is disposed above the layer of pyrotechnic 25. The layer of zeolite is maintained at a storage pressure of between about 30 and about 80 atm by the placement of a rupture disk 20 over the zeolite layer. The storage pressure will vary somewhat with the type of gas and the amount of gas stored, as well as the cost of the shell and rupture disk required to contain the stored gas. The rupture disk is sealingly disposed on the wall of the shell by any means well known in the art to hermetically seal the rupture disk to the sides of the shell.

EXAMPLES

The following examples are meant to illustrate the advantage of combining the gas storage of zeolite adsorbents and the use of pyrotechnic compounds in a hybrid gas generator for inflating airbags. Such hybrid inflators can deliver equal or greater volumes of gas at rates which are comparable to pyrotechnic devices at gas temperatures which are significantly lower than gas delivered by a solely pyrotechnic device.

Example I

Based on the chemical equations presented hereinabove as equations (1), (2), and (3), it is well known that a sodium azide based pyrotechnic will release about 1.4 to about 1.6 moles of nitrogen per 100 grams of the pyrotechnic charge which includes sodium azide ($NaN_3$), potassium nitrate ($KNO_3$), and silicate ($SiO_2$) which is sufficient to deploy a driver-side airbag in a passenger vehicle.

An apparatus to measure and characterize the gas storage capacity of an adsorbent was assembled. The test apparatus comprised a high-pressure containment vessel that was attached to a high-pressure gas cylinder with additional ports that allowed the vessel to be depressurized either through a large-diameter port that is controlled by a large orifice ¼ turn ball valve, or through a small needle valve, which in turn leads to a gas volume measurement device commonly called a wet test meter. The former allows a rapid and relatively non-restricted depressurization and the latter allows a slower, controlled depressurization of the vessel with measurement of the gas that is released. The high-pressure vessel had an internal volume of 310 cc. The high-pressure vessel was connected to a large orifice ¼ turn ball valve. The orifice of the ball valve was about 22 mm (0.85 inches) in diameter. The pipe that connects the vessel to the valve had an inside diameter of about 22 mm (0.88 inches). From the downstream end of the ball valve to the atmosphere, there was a short length of pipe having an inside diameter of about 22 mm (0.88 inches) and at the downstream of the end of the pipe, there was an expansion nozzle. The expansion nozzle provided a transition from an inside diameter of about 22 mm (0.88 inches) up to an inside diameter of about 34 mm (1.33 inches) over a length of about 15 mm (0.6 inches). Inside the vessel were two sets of 60 mesh screens. These screens were set inside the vessel to provide an adsorbent zone having a volume of approximately 260 cc between the screens. The capacity of the empty high-pressure vessel was determined to contain approximately 0.874 moles of nitrogen gas at about 68 atm pressure and ambient temperature. It was found that the empty high-pressure vessel could be depressurized from 68 atm to about 1 atm in about 50 milliseconds (0.050 seconds).

Example II

The adsorbent zone of Example I was filled with a first zeolite adsorbent (A) having a FAU structure with a nominal silica-to-alumina ratio of 2.45 and having a ratio of Li cations to Li+Na, which is a minimum of 96 percent and typically 97 percent. The zeolite adsorbent was characterized as small beads having a particle size distribution characterized as 20×50 mesh. The average particle size of these small beads was 0.46 mm before ion exchange. Approximately 155 grams of activated adsorbent was added to the high-pressure vessel. The adsorbent occupied approximately 260 cc. This left about 50 cc of non-adsorbent filled space. The adsorbent material also had voids in the macropores and interstitial spaces between particles that contribute non-selective gas storage space that amounted to about 163 cc, giving a total non-selective storage space of 214 cc. Slow depressurization experiments showed the capacity of the high-pressure vessel filled with the adsorbent of this Example II had a nitrogen capacity of about 1.184 moles and required about 180 milliseconds to be depressurized from about 68 atm to about 1 atm.

Example III

In Example III, the zeolite adsorbent of Example II was replaced with a second zeolite adsorbent (B) comprising a FAU structure having a silica-to-alumina ratio of approximately 2.3 and having about 67 percent of the cation sites, normally occupied by $Na^+$, replaced by $Ca^{++}$. About 159.2 grams of this material was loaded into the nominal 260-cc space between the screens of the high-pressure vessel. The material had a particle size distribution that was characterized as 10×20 mesh with an average particle size of about 1.46 mm. Slow depressurization experiments showed that at a pressure of about 68 atm, approximately 1.122 moles of nitrogen were released as the pressure of the vessel was reduced to 1 atm. The dynamic depressurization of the high pressure containing the zeolite adsorbent of Example II required about 100 milliseconds for the pressure to be reduced from about 68 atm to about 1 atm.

Example IV

In Example IV, the zeolite adsorbent of Example I was replaced with a third zeolite adsorbent (C) comprising another FAU, having a nominal silica-to-alumina ratio of about 2.3 and having most of the cation sites replaced by Li so that the ratio of Li to Li plus sodium was a minimum of 94 percent and more typically about 97 percent. This zeolite adsorbent (C) has a particle size distribution that is characterized as 8×12 mesh, having an average particle size of 1.9 mm. In the slow depressurization test, approximately 1.2 moles of gas were released between about 68 atm and 1 atm. Over the slow depressurization test of zeolite (C), the stored gas dropped in temperature by 46 Kelvin. The valve remained open until the adsorbent material had returned to room temperature. The rapid depressurization time for depressurizing the gas from about 68 atm to about 21.7 atm was about 28.9 milliseconds (about 0.029 seconds).

The hereinabove described experimental device deviated from a real gas inflator in at least two important ways. Inflator performance measurement was in all cases limited by the opening time of the ball valve, that starts the rapid blow down, and by the size of the orifice through which the gas flow passes. In a more realistic experiment, there will be a larger and less restrictive orifice and a more rapid opening time. Engineering simulations of the results characterized the opening time of the valve from a zero orifice time to full throat as 0.027 seconds and the orifice area was limited by the about 21.6 mm (0.85-inch) diameter of the valve throat. With respect to the zeolite adsorbent evaluation, it was surprisingly discovered that there was a remarkable trend with bead size of the adsorbent. As the bead size increased, the net resistance to flow out of the system decreased in what appeared to be a linear fashion.

Example V

Comparison of $N_2$ Hybrid Inflator to Pyrotechnic

Based on the results of the above Examples I–IV, a mathematical model was constructed to simulate the operation of a hybrid zeolite inflator to compare the operation of a hybrid zeolite system, wherein a portion of the inflation gas is provided from storage in the zeolite and a portion of the inflation gas is supplied from the generation of gas by a pyrotechnic and delivered to an airbag. The heat released by the pyrotechnic device is employed to heat the zeolite to promote the desorption of the stored gas. The total inflation gas is the calculated gas delivery from the model plus the gas released by the pyrotechnic device. Literature shows driver-side airbag examples ranging from as low as 30 liters up to about 70 liters. For the purposes of this Example V, a 40-liter volume airbag, a minimum over pressure of about 0.1283 atm, (1.88 psig) a final gas temperature of 277° C. (550 Kelvin) are selected as the basis for comparison to the basic pyrotechnic device.

TABLE I

Nitrogen Released from Increasing Mass of Zeolite

| Mass of molecular sieve, grams | Mass of gas released to the airbag within 50 ms, moles | Mass average temperature of the expanded gas, ° C. (Kelvin) | Pressure inside the fully inflated bag 40-liter bag at the end of 50 ms., atm |
|---|---|---|---|
| 0 | 0.6225 | 2435 (2708) | 3.458 |
| 5 | 0.6436 | 1706 (1979) | 2.613 |
| 10 | 0.6649 | 1305 (1578) | 2.15 |
| 20 | 0.7083 | 884 (1158) | 1.683 |
| 30 | 0.7511 | 652 (926) | 1.4268 |
| 40 | 0.7906 | 504 (778) | 1.268 |
| 50 | 0.8273 | 400 (674) | 1.144 |

TABLE I-continued

Nitrogen Released from Increasing Mass of Zeolite

| Mass of molecular sieve, grams | Mass of gas released to the airbag within 50 ms, moles | Mass average temperature of the expanded gas, ° C. (Kelvin) | Pressure inside the fully inflated bag 40-liter bag at the end of 50 ms., atm |
|---|---|---|---|
| 60 | 0.8622 | 324 (597) | 1.055 |
| 70 | 0.8960 | 264 (537) | 0.9871 |
| 50 | Pyro-technic 1.1200 | | |
| | MS 0.2020 | | |
| | Gas 0.1833 | | |
| | Total 1.5053 | | |

The model uses a pyrotechnic charge of about 70 grams of $NaN_3$ to inflate a 40-liter driver-side airbag, with incremental added amounts of zeolite adsorbent, pre-loaded with nitrogen. The dynamic gas release and average gas temperature of the gas delivered to the airbag are determined by the model. When zeolite molecular sieve which was pre-loaded with nitrogen is incorporated into the pyrotechnic inflator over a range of from 5 to about 70 grams of zeolite, significant cooling of the product gases resulted which still delivered an airbag pressure in a 40-liter airbag of about 1 atm. At about 50 grams of nitrogen pre-loaded zeolite molecular sieve, the pressure delivered to the airbag is sufficient to inflate the airbag with a desired level while reducing the delivered temperature at 50 ms after the detonation by a factor of about 6. The gas temperatures calculated and shown in Tables I and II represent the temperature of the gas at the entrance to the airbag. Significant further cooling will take place within the airbag but is not considered in this analysis. The results in Table I show an advantage for combining the functions of gas storage by zeolite adsorbents with the gas and heat releases of pyrotechnic compounds to significantly reduce the temperature of the gas delivered to the airbag. The zeolite hybrid generator can inflate the airbag with nitrogen gas within time periods that are very comparable with existing pyrotechnic devices while delivering the gas at temperatures that are much cooler than the gas delivered by the solely pyrotechnic devices. Pressures less about 1.13 atm inside the fully inflated airbag at the end of 50 ms will inflate the airbag, but not aggressively enough to provide the same performance as that of the pyrotechnic device.

Example VII

Comparison of $CO_2$ Hybrid Inflator to Pyrotechnic

Based on the simulation of the hybrid zeolite inflator of Example VI, a simulation for the use of zeolite pre-loaded with stored carbon dioxide is considered. The results shown in Table II show that the temperature of the combined generated gases and stored gasses is reduced from about 2400° to about 391° by the placement of about 50 grams of zeolite molecular sieve pre-loaded with carbon dioxide at a storage pressure of about 5 atm while still generating sufficient pressure inside the airbag at the end of a 50 ms inflation period while reducing the delivered temperature by about a factor of 4. As in Example VI, significant further cooling in the airbag is not considered.

TABLE II

| Mass of Molecular Sieves, grams | Mass of Gas Released within 50 ms, moles | Mass averaged temperature of the expanded gas, ° C. (Kelvin) | Pressure inside a fully inflated 40-liter bag at the end of 50 ms, atm |
|---|---|---|---|
| | Mass of Nitrogen plus $CO_2$ Released | | |
| 0 | 0.6225 | 2435 (2708) | 3.458 |
| 10 | 0.6649 | 1304 (1578) | 2.15 |
| 50 | 0.8273 | 391 (665) | 1.1286 |
| 50 | Pyro-technic 1.1200 | | |
| | MS 0.2300 | | |
| | Gas 0.0135 | | |
| | Total 1.3635 | | |

The addition of the carbon dioxide pre-loaded or encapsulated molecular sieve zeolite to the inflator system at pressures less than about 5 atm provides significant reduction in the temperature of the gas delivered to the airbag without the need for high-pressure gas storage in the inflator.

I claim:

1. A process for reducing the temperature of an inflating airbag, said process comprising:

a) detonating an airbag inflator comprising a pyrotechnic adjacent to a zeolite molecular sieve, said molecular sieve being pre-loaded with a stored gas, said pyrotechnic providing a generated gas comprising toxic compounds to inflate the inflating airbag;

b) desorbing and expanding the stored gas from the zeolite molecular sieve to cool the generated gas and fluidizing at least a portion of the zeolite molecular sieve; and, c) adsorbing at least a portion of the toxic compounds on the zeolite molecular sieve.

2. The process of claim 1 wherein the zeolite molecular sieve comprises a zeolite X.

3. The process of claim 1 wherein the pyrotechnic is selected from the group consisting of sodium azide, nitrocellulose, or mixtures thereof.

4. The process of claim 1 wherein the zeolite molecular sieve is present according to a weight percentage of the pyrotechnic within a range of 25 to 70 weight percent of the pyrotechnic.

5. The process of claim 1 wherein the zeolite molecular sieve comprises a highly exchanged zeolite X with a cation selected from the group consisting of sodium, lithium, calcium and mixtures thereof.

6. The process of claim 1 wherein the zeolite molecular sieve comprises a highly exchanged zeolite X, having been at least 67 percent exchanged with a cation selected from the group consisting of sodium, lithium, calcium and mixtures thereof.

7. The process of claim 1 wherein the stored gas comprises nitrogen.

8. The process of claim 1 wherein the zeolite molecular sieve comprises a particle size between about 1.4 and about 1.9 mm.

9. The process of claim 1 wherein the zeolite molecular sieve is selected from the group consisting of potassium zeolite A, potassium erionite, sodium clinoptilolite, and mixtures thereof.

* * * * *